US010766657B2

(12) United States Patent
Baron

(10) Patent No.: US 10,766,657 B2
(45) Date of Patent: Sep. 8, 2020

(54) SANDBAGGING ATTACHMENT TO A TILTABLE DOLLY

(71) Applicant: Ben Baron, Canyon Country, CA (US)

(72) Inventor: Ben Baron, Canyon Country, CA (US)

( * ) Notice: Subject to any disclaimer, the term of this patent is extended or adjusted under 35 U.S.C. 154(b) by 41 days.

(21) Appl. No.: 16/211,171

(22) Filed: Dec. 5, 2018

(65) Prior Publication Data

US 2020/0180805 A1 Jun. 11, 2020

(51) Int. Cl.
*B65B 67/12* (2006.01)

(52) U.S. Cl.
CPC ..... *B65B 67/1233* (2013.01)

(58) Field of Classification Search
CPC ..... B65B 7/12; B65B 7/1211; B65B 7/1222; B65B 7/1233
See application file for complete search history.

(56) References Cited

U.S. PATENT DOCUMENTS

| | | | | |
|---|---|---|---|---|
| 430,355 | A | 6/1890 | Stone | |
| 879,177 | A * | 2/1908 | Johnson | B65B 67/12 248/101 |
| 5,395,147 | A | 3/1995 | Brown et al. | |
| 5,802,807 | A | 9/1998 | Johnson | |
| 6,896,015 | B2 | 5/2005 | Beveridge | |
| 7,942,171 | B2 | 5/2011 | Hartley, III | |
| 2011/0011492 | A1 | 1/2011 | Shahbazian | |

* cited by examiner

*Primary Examiner* — Craig M Schneider
*Assistant Examiner* — Jason K Niesz

(57) ABSTRACT

A sandbagging attachment to a tiltable dolly for filling bags with scoopable materials such as sand without use of shovels and for subsequent transportation of the filled bags to the destination by using the same dolly. The attachment contains a connection member for connecting the attachment to the dolly and a scoop with a through passage for a material to be scooped. The connection member rotationally supports a scoop that can be turned between a scooping position for filling a bag and a transportation position, at which the filled bag can be transported by the dolly to the destination. The attachment eliminates a need for a special sandbagging equipment. All aforementioned operations are accomplished without the use of manual labor, except for transporting the dolly and removing the filled bag from the dolly.

20 Claims, 3 Drawing Sheets

SANDBAGGING ATTACHMENT TO A TILTABLE DOLLY

FIELD OF THE INVENTION

The present invention relates to the field of sandbagging, and more particularly, to a sandbagging attachment to a conventional two-wheel dolly of the type also known as a hand truck, two-wheeler, stack truck, trundler, box cart, sack barrow, cart, etc. Such a dolly has a small platform onto which the load is placed. Upon loading, the dolly is tilted back as a first-class lever for placing the load into a position stable on the platform and then tilted down at the place of destination for unloading. The attachment of the invention makes it possible to simply secure this device to any standard tiltable two-wheeler, secure a bag on it, fill the bag with sand without use of shovels, and deliver the filled bag to a required location. All these operations are accomplished without the use of manual labor, except for transporting the dolly and removing the filled bag from the dolly.

BACKGROUND OF THE INVENTION

Without entering into a discussion about whether global warming and climate change are occurring or not, the statistics of recent years show that over the past five years the number of floods has more than doubled compared with the previous five years.

Meanwhile, the use of sandbags is still a simple and effective way to prevent a damage that may be caused by flooding. A barrier formed by properly filled and arranged sandbags may prevent penetration of water into the building and divert moving water around it.

Traditionally, sandbags are filled manually by using shovels. Filling sandbags involves a team of three people. One team member will hold open the bag to form a collar opening, the second team member places the tip of a pointed shovel with sand into the opened sandbag, and the third team member will transport and stockpile the filled sandbags.

Known in the art are various specific devices and machines for filling bags with sand without involving or alleviating the manual labor. Some examples of such devices and mechanisms are disclosed in the patent documents given below.

U.S. Pat. No. 430,355 issued on Jun. 17, 1890 to Stone discloses a wheeled frame having a combined shovel and hopper at its upper or forward end, provided in its bottom or lower end with an opening, of a bag-holder at the opening and a bag-supporting platform behind or below the holder. A hook to engage the bottom of the bag is provided. The combination, with the frame having a bag-holder at its upper end, of a tilting bag-supporting platform below the holder. The frame has a bag-holder at its upper end and cross-bars on which the platform is pivoted below the holder, the pivoted ends of the platform at one side of the pivots projecting over the cross-pieces to stop the pivot from tilting downwardly from that side, the said ends at the opposite sides of the pivots being constructed to swing downwardly between the cross-pieces to dump the bag.

U.S. Pat. No. 5,395,147 issued on Mar. 7, 1995 to Brown, et al. discloses a two-handed scoop apparatus for filling conventional sandbags comprises an elongate rigid scoop having a generally semicircular transverse cross section defining an open upper region and open longitudinal end regions and first and second similar, inverted U-shaped, elongate handles, lower end regions of which are pivotally attached to opposing side regions of the scoop so that each handle straddles the open upper region of the scoop, the first and second handles being attached to the scoop in a longitudinally spaced apart relationship near ends thereof. A transverse cross brace is attached across each handle and a clip is fixed to each cross brace for detachably attaching an open end of a conventional sandbag to either end of the scoop so that when the scoop apparatus is moved in a direction away from the sandbag to scoop up sand or other material to fill the sandbag, the sandbag is moved along with the scoop apparatus, A bag is supported by a hook U.S. Pat. No. 5,802,807 issued on Sep. 8, 1998 to Johnson discloses a versatile apparatus designed specifically for quickly and easily filling bags of sand, dirt, or other particulate material, which includes a scoop mounted on a lower frame and upwardly extending handles, which are braced to the lower frame in use. A latch is provided to detachably secure a bag to the scoop during filling. The entire apparatus can be folded for storage, including relocation of ground wheels and push handles to minimize external size. The invention includes a simplified form for light duty usage.

U.S. Pat. No. 6,896,015 issued on May 24, 2005 to Beveridge discloses a bag holding and filling device that has a light strong portable framework to hold a sandbag, or similar flexible container. The bag to be filled is secured by means of four hooks two of which are arranged on swinging arms and two on the main framework. These hooks engage with the open neck of the sandbag and hold the top of the bag open. A conical shaped funnel with an included angle of approximately 80° is pivotally mounted on the framework so that the funnel is supported in a position such that any material fed into the funnel will be guided into the open neck of the bag. The funnel swings into another position in which access is available to the hooks to place or remove the bag. A spring or springs tension the bag hooks on the swinging arms so that the bag is securely held on the hooks during the filling operation. The bent tubular framework provides strength with lightness and is formed to facilitate hand carrying. The framework is supported on legs that are removable and the funnel is detachable and reattaches into the framework to create a simple and resilient reconstruction of the device with minimal use of space for storage and transport.

U.S. Pat. No. 7,942,171 issued on May 17, 2011 to Hartley III discloses a device and a method for filling multiple sandbags at a time. The patent relates to an implement for mechanically filling multiple sandbags at a time and is used on a loader bucket of loader-type equipment. The implement has a planar surface in which a plurality of filler apertures are formed in a plurality of rows evenly spaced over its surface area. Each filler aperture has a tensioner ring around the aperture for holding a drawstring held in a sleeve around an open end of the sandbag. A trigger mechanism can be moved to a locked position, in which the drawstring of the sandbag is pulled tight so that the open end of the sandbag is held in place on the tensioner ring. The trigger mechanism can be switched to an unlocked position in which the trigger mechanism lifts the drawstring off the tensioner ring to allow the sandbag filled with filler material to pull on and cinch the open end of the sandbag closed. It can also be switched to a release position in which the cinched sandbag is released to the ground.

US Patent Application Publication No. 2011/0011492A published on Jan. 20, 2011 (Inventor: Shahbazian) discloses a two-wheel device which is designed specifically for filling bags with particulate matter such as sand. The device consists of a scoop with open front and rear ends for passing sand therethrough. The scoop is carried by a first frame member and a second frame member between which the scoop is located and is supported so that the forward opening receives the sand therein as the device is moved forward. The device also has a first arm extending in a curved manner from the first frame member and a second arm extending in a curved manner from said second frame member such that a first and second handle region of the arms extends back over the scoop, whereby a fulcrum point is located behind the handle regions to allow the scoop member to be easily tilted backward. A bag covers the rearward opening for filling the bag with the sand when the device is tilted. A retainer positioned over the rearward opening is provided to maintain the bag in an open position, yet the retainer is extractable after the bag has been filled with the sand. Therefore, the device does not require a latch.

BRIEF DESCRIPTION OF THE DRAWINGS

FIG. 38 is a side view of a two-wheeler with the attachment of the invention in an intermediate position between the scooping and transportation positions.

SUMMARY OF THE INVENTION

The present invention relates to the field of sandbagging, and more particularly, to a sandbagging attachment for securing to a conventional two-wheel dolly of the type also known as a hand truck, two-wheeler, stack truck, trundler, box cart, etc. The attachment of the invention makes it possible to simply secure the attachment to any standard tiltable two-wheeler, secure a bag on it, fill the bag with sand or any other scoopable material without use of shovels, and deliver the filled bag to a required location. A sandbagging attachment, which hereinafter is referred to simply as an "attachment", contains a connectable/disconnectable dolly connection member for connecting the attachment to the chassis of a dolly. The connection member rigidly supports a scoop with a through passage for a sand or any other material to be scooped. A bag is secured to the scoop with an open side facing the inlet end of the scoop. The scoop is rotationally supported on the connection member for turning between a lower or scooping position, at which the bag is filled with the scoped sand, and a raised and transportation position, at which the filled bag can be transported by the dolly to the destination.

DETAILED DESCRIPTION OF THE INVENTION

The present invention relates to the field of sandbagging, and more particularly, to a sandbagging attachment (hereinafter "attachment") to a conventional two-wheel dolly of the type also known as a hand truck, two wheeler, stack truck, trundler, box cart, sack barrow, cart, etc. Such a dolly has a small platform, onto which the load is placed. Upon loading, the dolly is tilted back as a first-class lever for placing the load into a position stable on the platform and then tilted down at the place of destination for unloading. The attachment of the invention makes it possible to simply secure this device to any standard tiltable two-wheeler, secure a bag on it, fill the bag with sand without use of shovels, and deliver the filled bag to a required location. All these operations are accomplished without use of manual labor, except for transporting the dolly and removal of the filled bag from the latter.

Figure 1:
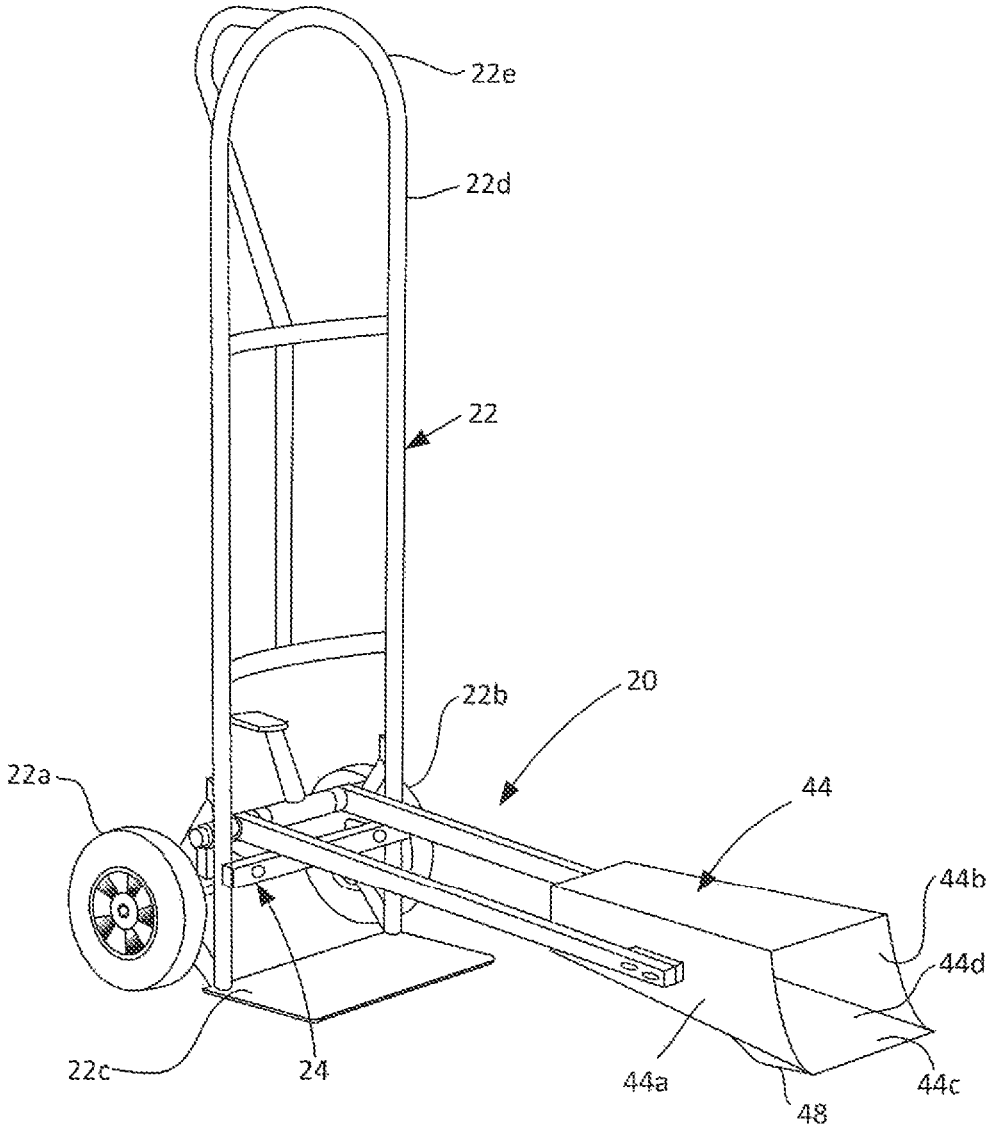
FIG. 1 is a three-dimensional view of the sandbagging attachment of the invention secured in a working position on a conventional two-wheeler.

The attachment of the invention, which in general is designated by reference numeral 20, is shown in an assembled state and in a position secured to a dolly 22 in FIG. 1, which is a three-dimensional view. It can be a standard tiltable two-wheeler, e.g., a Loop Handle Steel Hand Truck with Rubber Wheels Model H-1786, purchasable from Pleasant Prairie, Wis. The dolly 22 has chasses on two wheels 22*a*, 22*b*, a load platform 22*c*, and a frame 22*d* with a loop-like handle 22*e*. The dolly of this type is given only as an example and many other dollies are suitable for the purposes of the invention. In any case, the dolly 22 is not a subject of the invention and is beyond the invention scope. It is important, however, that the dolly is a tiltable two-wheeler that can be tilted back as a first-class lever for placing the load into a position stable on the platform and then tilted down at the place of destination for unloading.

Figure 2:
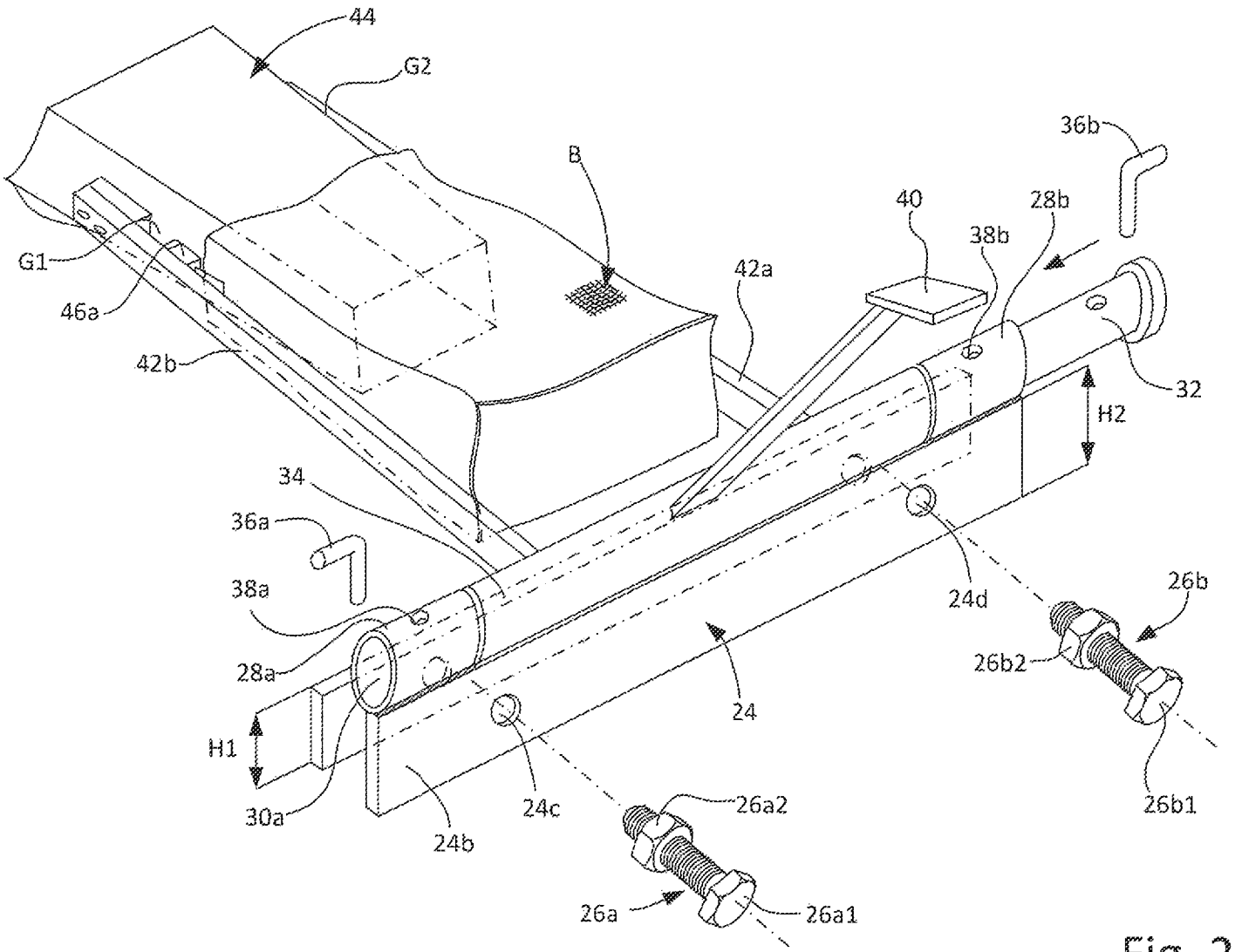
FIG. 2 is a partial three-dimensional exploded view of the attachment device of the invention shown in more detail.

The attachment 20 has a connectable/disconnectable dolly connection member 24 shown in more details in FIG. 2, which is a partial three-dimensional view of the attachment 20.

The connectable/disconnectable dolly connection member 24 is formed by a pair of plates, i.e., a front plate 24*a* and a rear plate 24*b*, with at least two pairs of aligned openings 24*c* and 24*d* (the openings of the front plate 24*a* are shown by broken lines and not designated) and at least two fastening devices 26*a* and 26*b* for securing the connectable/disconnectable dolly connection member 24 to the dolly 20 by sandwiching the lower part of the dolly frame member 22*d* between the front plate 24*a* and the rear plate 24*b* in their connected state shown in FIG. 1. The fastening devices are shown as bolts 26*a*1, 26*b*1 and nuts 26*a*2, 26*b*2. It is understood that for clamping the attachment connection member 24 to the dolly frame member 22*d*, the nuts 26*a*2 and 26*b*2 are to be threaded onto the ends of the bolts 26*a*, 26*b*1 protruding outward through the respective openings of the front plate 24*a* and tightened on the protruding ends.

Attached, e.g., welded, to the upper face of the rear plate 24*b* are rotary bearing portions 28*a* and 28*b* installed on the left and right sides of the plate 24*b*. The rotary bearing portions 28*a* and 28*b* have aligned openings (only one opening 30*a* is shown and designated) for insertion of an axle 32 through both openings and through a tubular sleeve 34, which is, as shown in FIG. 2, is placed between the rotary bearing portions 28*a* and 28*b* and constitutes a rotationally supported part. The axle 32 is fixed in the rotary bearing portions 28*a* and 28*b* by L-shaped pins 36*a* and 36*b* through openings 38*a* and 38*b*, respectively. The L-shaped pins 36*a* and 36*b* are shown as examples, and other means can be used for securing the axle 32.

The sleeve 34 has a sliding fit on the fixed axle 32 so that the tubular sleeve 34 is installed on the axle 32 rotationally.

A foot pedal 40 is attached to the sleeve 34 in a radially outward direction. To prevent contact of the pedal 40 with the front plate 24*a*, when the pedal is pushed down for rotation in the counterclockwise direction, the front plate 24*a* has a height H1 lower than the height H2 of the rear plate 24*b*.

A pair of scoop holding members 42*a* and 42*b*, which rigidly support a scoop 44, is rigidly attached, e.g., by welding, at one ends to the scoop 44. At the opposite ends the scoop holding members 42*a* and 42*b* are attached to the tubular sleeve 34. The scoop holding members 42*a* and 42*b*, and hence the scoop 40, also extend radially outward from the sleeve 34 but are attached to the outer surface of the scoop 44 in an intermediate position between the open front end and the open rear end of the scoop. Angularly, the scoop-holding members 42*a* and 42*b* are shifted from the position of the pedal 40 to provide convenient manipulation of the scoop by using the pedal.

The scoop 44 itself is defined by sidewalls 44*a*, 44*b* and a bottom plate 44*c*. The scoop 44 has an open front end 44*d* and an open rear end 44*e* (FIG. 2) for forming a through passage between the front end and the rear end and thus for passing a scoopable material, such as sand, grain, or the like, through the scoop to a bag B which can be fitted onto the scoop from the open rear end. For this purpose, gaps G1 and G2 are formed between the sidewalls 44*a*, 44*b* and the scoop-holding members 42*a* and 42*b*. The front end of the bag is inserted into the gaps G1 and G2.

The front end of the bag is secured to the sides of the scoop 44 by the bag securing devices for keeping the bag open during the scooping operation. For this purpose a small bag-securing device 46*a* is used (a similar bag-securing device not seen in the drawings is located on the other side 44*b*). The securing device may be represented, e.g., by toggle clamps located near said intermediate positions and attached to the outer surfaces of the sidewalls 44*a* and 44*b* (FIG. 1). An example of such a securing device is a toggle clamp E-TING New 4PCS Hand Tool Toggle Clamp 201A Antislip Red Horizontal Clamp 201-A, available from Amazon.

For preventing sticking of the edge of the open front end 44*d* of the scoop 44 into the ground G and for scooping the sand S only, the scoop 44 has on the outer side of the bottom plate 44*c* near the open front end an arc-shaped slider 48. The slider 48 may extend over the entire width of the front edge of the scoop 44 or may consist of two arc-shaped portions installed on the sides of the bottom plate.

Figure 3C:
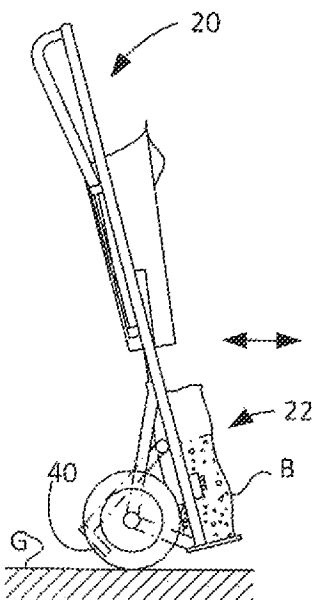
FIG. 3C is a side view of a two-wheeler with the attachment of the invention in a bag transportation position.
Figure 3B:
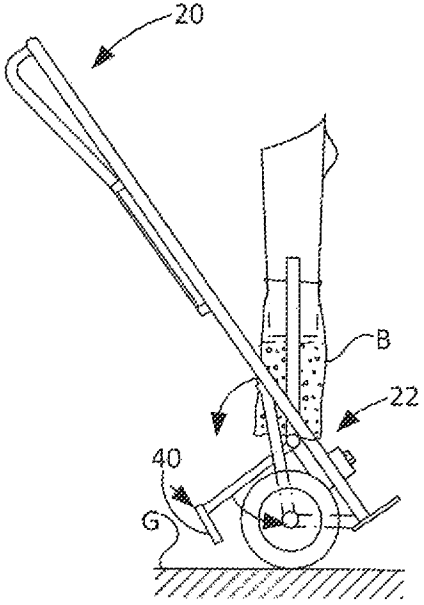
FIG. 3A is a side view of a two-wheeler with the attachment of the invention in a sand scooping position.

An operation of the attachment 22 will now be described with reference to FIGS. 3A, 3B, and 3C.

If the attachment 22 is stored separately from the dolly 20, it should first be firmly secured to the dolly by clamping the front and rear plates 24*a* and 24*b* to the lower part of the frame member 22*d* of the dolly 20. This is done by sandwiching the lower part of the frame member 22*d* between the plates 24*a* and 24*b* and tightening the nuts 26*a*2 and 26*b*2 on the ends of the bolts 26*a*1 and 26*b*1 inserted into and protruding from the openings 24*c* and 24*d*. The plates are secured in positions shown in FIGS. 1 and 2 so that the scoop 44 extends in a forward direction of the dolly. In this state, the foot pedal is oriented in a position convenient for pressing by foot.

A bag B is fitted onto the scoop 44 from the side of the rear open end 44*e* and guided further over the scoop through the gaps G1 and G2 to the area where the front end of the bag B can be clamped to the outer surfaces of the sidewalls 44*a* and 44*b* by toggle clamps, such as the clamp 46*a* (FIG. 2). This is necessary to keep the bag in an open state during scooping. The attachment is now ready for use.

Figure 3A:
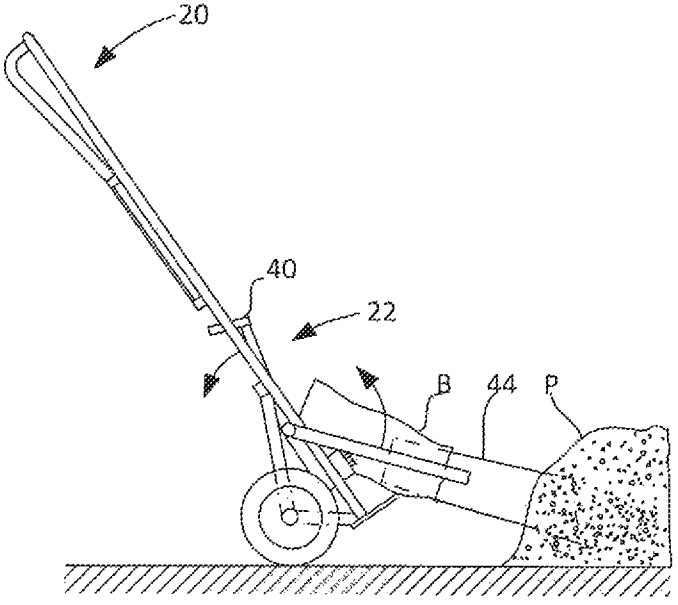

In FIG. 3A, the attachment 22 is shown in a position for scooping a portion of sand S from a pile P. A user (not shown) pushes the dolly 20, and hence the scoop 44, forward for digging the sand. The bag is filled to a certain level leaving the upper part of the bag free for tying it up.

Next, upon completion of the filling operation, the user pushes down on the pedal for turning the scoop 44 with the filled bag B to a counterclockwise direction. Under its own weight, the filled bag goes down until it rests on tubular sleeve 34. This condition is shown in FIG. 3B. The user then raises the bag and places it onto the load platform 22*c* of the dolly. In this position, which is shown in FIG. 3C, the dolly 20 may transport the filled bag to the destination without a risk of rollover.

Although the attachment of the invention was shown and described with reference to specific embodiments, it is understood that these embodiments cannot be considered as limitative and that any changes and modifications are possible without deviation from the scope of the attached claims. For example, the attachment may be used for bagging grains, wooden chips, or any other bulk and scoopable materials. The connection member can be secured to the frame of the dolly by means other than threaded fasteners. Hooks can be used for securing the upper end of the bag to the scoop. The pedal may be removable. The axle may remain loose in the bearing supports. Additional bag security means such as a chain or rope may be used for fixing the bag during the transportation.

What I claim is:

1. A sandbagging attachment to a tiltable dolly having a chassis for moving the dolly on the ground with two wheels on a single axis and a dolly frame member having an upper end with a handle portion and a lower end for connection of the handle member to the chassis, the sandbagging attachment comprising:

a connectable/disconnectable dolly connection member for connecting the sandbagging attachment to the chassis of the dolly;

a scoop comprising:

sidewalls;

an open front end for scooping a sand thus forming a scooped sand;

an open rear end for passage of the scooped sand;

a bottom surface; and scoop holding members having one ends rigidly attached to the sidewalls of the scoop in an intermediate position between the open front end and the open rear end of the scoop, gaps for inserting and securing a bag to the scoop being formed between the sidewalls and the scoop holding members;

rotary bearing portion installed on the connectable/disconnectable dolly connection member for rotationally supporting ends of the scoop holding members opposite to said one ends; and a foot pedal rigidly secured to the connectable/disconnectable dolly connection member for tilting the scoop up during transportation of a bag filled with a sand.

2. The sandbagging attachment according to claim 1, wherein the connectable/disconnectable dolly connection member comprises:

a front plate and a rear plate with at least two pairs of aligned openings and at least two fasteners for securing the connectable/disconnectable dolly connection member to the dolly by sandwiching the dolly frame member between the front plate and the rear plate in their connected state.

3. The sandbagging attachment according to claim 1, wherein the sidewalls of the scoop are further provided with bag securing devices located near said intermediate positions for securing a bag to the scoop after the bag was inserted into said gaps.

4. The sandbagging attachment according to claim 2, wherein the sidewalls of the scoop are further provided with bag securing devices located near said intermediate positions for securing a bag to the scoop after the bag was inserted into said gaps.

5. The sandbagging attachment according to claim 2, wherein the front plate has a lower height than the rear plate.

6. The sandbagging attachment according to claim 1, wherein the scoop has on the bottom surface near the open front end an arc-shaped slider for preventing sticking of the open front end of the scoop into the ground and for scooping a sand only.

7. The sandbagging attachment according to claim 3, wherein the scoop has on the bottom surface near the open front end an arc-shaped slider for preventing sticking of the open front end of the scoop into the ground and for scooping a sand only.

8. The sandbagging attachment according to claim 3, wherein the bag securing devices are toggle clamps.

9. The sandbagging attachment according to claim 4, wherein the bag securing devices are toggle clamps.

10. The sandbagging attachment according to claim 1, wherein the rotary bearing portion comprises: a pair of bearing supports separated by a space from each other and secured to the connectable/disconnectable dolly connection member; a tubular sleeve placed into said space coaxially with the bearing supports; and a rotation axle inserted into the bearing supports through the tubular sleeve and fixed in the bearing supports, wherein the tubular sleeve is rigidly connected to the scoop holding members opposite to said one ends and rotationally supported by the rotation axle.

11. The sandbagging attachment according to claim 6, wherein the rotary bearing portion comprises: a pair of bearing supports separated by a space from each other and secured to the connectable/disconnectable dolly connection member; a tubular sleeve placed into said space coaxially with the bearing supports; and a rotation axle inserted into the bearing supports through the tubular sleeve and fixed in the bearing supports, wherein the tubular sleeve is rigidly connected to the scoop holding members opposite to said one ends and rotationally supported by the rotation axle.

12. The sandbagging attachment according to claim 9, wherein the rotary bearing portion comprises: a pair of bearing supports separated by a space from each other and secured to the connectable/disconnectable dolly connection member; a tubular sleeve placed into said space coaxially with the bearing supports; and a rotation axle inserted into the bearing supports through the tubular sleeve and fixed in the bearing supports, wherein the tubular sleeve is rigidly connected to the scoop holding members opposite to said one ends and rotationally supported by the rotation axle.

13. A sandbagging attachment to a tiltable dolly having a chassis for moving the dolly on the ground with two wheels on a single axis and a dolly frame member having an upper end with a handle portion and a lower end for connection of the handle member to the chassis, the sandbagging attachment comprising:

a connectable/disconnectable dolly connection member for connecting the attachment to the chassis of the dolly;

a scoop with a through passage for a material to be scooped, the scoop being rotationally supported by the connectable/disconnectable dolly connection member for turning between a scooping position for filling a bag attached to the scoop with the material to be scooped and a transportation position, at which the filled bag can be transported by the dolly to the destination.

14. The sandbagging attachment to a tiltable dolly according to claim 13, further comprising a foot pedal attached to the dolly connection member for turning the scoop between the scooping position and the transportation position.

15. The sandbagging attachment to a tiltable dolly according to claim 14, wherein the connectable/disconnectable dolly connection member comprises a front plate and a rear plate with at least two pairs of aligned openings and at least two fasteners for securing the connectable/disconnectable dolly connection member to the dolly by sandwiching the dolly frame member between the front plate and the rear plate in their connected state.

16. The sandbagging attachment to a tiltable dolly according to claim 15, wherein the scoop comprises: sidewalls, a bottom surface; an open front end, and an open rear end; the sandbagging attachment further comprising scoop holding members rigidly attached at one ends thereof to the sidewalls of the scoop in an intermediate position between the open front end and the open rear end of the scoop, gaps for inserting and securing a bag to the scoop being formed between the sidewalls and the scoop holding members; and bag securing devices for securing a bag to the scoop attached to the sidewalls of the scoop.

17. The sandbagging attachment to a tiltable dolly according to claim 16, wherein the scoop has on the bottom surface near the open front end an arc-shaped slider for preventing sticking of the open front end of the scoop into the ground and for scoopable material only.

18. The sandbagging attachment to a tiltable dolly according to claim 16, wherein the bag securing devices are toggle clamps.

19. The sandbagging attachment to a tiltable dolly according to claim 17, wherein the bag securing devices are toggle clamps.

20. The sandbagging attachment to a tiltable dolly according to claim 19, wherein the front plate has a lower height than the rear plate, the sandbag attachment being further provided with a rotary bearing portion and with a rotational bearing part which is rigidly attached to the connectable/disconnectable dolly connection member and rotationally supports ends of the of the scoop holding members located opposite to said one ends on the rotational bearing part.

* * * * *